US010632603B2

(12) United States Patent
Hu

(10) Patent No.: US 10,632,603 B2
(45) Date of Patent: Apr. 28, 2020

(54) ANVIL PIECE OF STAPLER

(71) Applicant: APEX MFG. CO., LTD., Taichung (TW)

(72) Inventor: Chih-Wei Hu, Taichung (TW)

(73) Assignee: APEX MFG. CO., LTD., Taichung (TW)

( * ) Notice: Subject to any disclaimer, the term of this patent is extended or adjusted under 35 U.S.C. 154(b) by 393 days.

(21) Appl. No.: 15/806,929

(22) Filed: Nov. 8, 2017

(65) Prior Publication Data

US 2019/0134797 A1 May 9, 2019

(51) Int. Cl.
*B25C 5/02* (2006.01)

(52) U.S. Cl.
CPC ..... *B25C 5/0207* (2013.01); *B25C 5/025* (2013.01); *B25C 5/0228* (2013.01)

(58) Field of Classification Search
CPC ..... B25C 5/0207; B25C 5/0228; B25C 5/025
USPC ..... 227/155
See application file for complete search history.

(56) References Cited

FOREIGN PATENT DOCUMENTS

| | | |
|---|---|---|
| CN | 1305689 C | 3/2007 |
| TW | M527368 U | 8/2016 |

*Primary Examiner* — Michelle Lopez
(74) *Attorney, Agent, or Firm* — Muncy, Geissler, Olds & Lowe, P.C.

(57) ABSTRACT

An anvil piece of a stapler is provided, including a main body, a crimp groove unit recessed on the main body and including at least one crimp groove, and an export unit. Each said crimp groove is for receiving a leg of a staple and has a blocking face which extends along a guiding path, and each said blocking face is for blocking the leg and making the leg bend along the guiding path; the export unit is recessed on the main body and communicates with the crimp groove unit on an extraction direction, the extraction direction is transverse to the guiding path and away from the crimp groove unit, the export unit includes at least exporting groove, each said exporting groove has an exporting face, and each said exporting face is for the leg which is bent to abuttingly slide therealong.

10 Claims, 10 Drawing Sheets

ANVIL PIECE OF STAPLER

BACKGROUND OF THE INVENTION

Field of the Invention

The present invention relates to an anvil piece of a stapler.

Description of the Prior Art

A stapler is one kind of stationery which is used most frequently. The stapler binds pages into a book or connects different objects mainly through having a staple disposed through objects to be stapled (for example, a plurality of papers or two different objects), bending legs of the staple via a crimp groove unit which is disposed on an anvil piece corresponding to a staple outlet, and then stringing the objects to be stapled together. This type of anvil piece of a stapler is disclosed in TWM527368 and CN1305689.

It is understandable that in the above-mentioned staplers, a distance between the staple outlet and the anvil piece is the greatest thickness of the objects that the stapler is expected to staple. However, when a staple is stapled on the objects, a thickness increases; thus, the staple often gets stuck in a crimp groove, the objects which have been stapled cannot be extracted from the stapler smoothly, or the legs of the staple may be deformed when being pulled too hard and unable to hook on and restrict the objects firmly.

The present invention has arisen to mitigate and/or obviate the afore-described disadvantages.

SUMMARY OF THE INVENTION

The major object of the present invention is to provide an anvil piece of a stapler, when the stapler is used to staple objects which have a thickness equal to a greatest depth that the stapler is able to staple, an export unit allows a user to smoothly extract the objects (a plurality of papers) which have been stapled from the stapler.

To achieve the above and other objects, an anvil piece of a stapler is provided, including a main body, a crimp groove unit and an export unit. The crimp groove unit is recessed on the main body for corresponding to a staple outlet, the crimp groove unit includes at least one crimp groove, each said crimp groove is for receiving a leg of a staple, each said crimp groove has a blocking face which extends along a guiding path, and each said blocking face is for blocking the leg and making the leg bend along the guiding path; the export unit is recessed on the main body and communicates with the crimp groove unit on an extraction direction, the extraction direction is transverse to the guiding path and away from the crimp groove unit, the export unit includes at least exporting groove, each said exporting groove has an exporting face, and each said exporting face is for the leg which is bent to abuttingly slide therealong.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
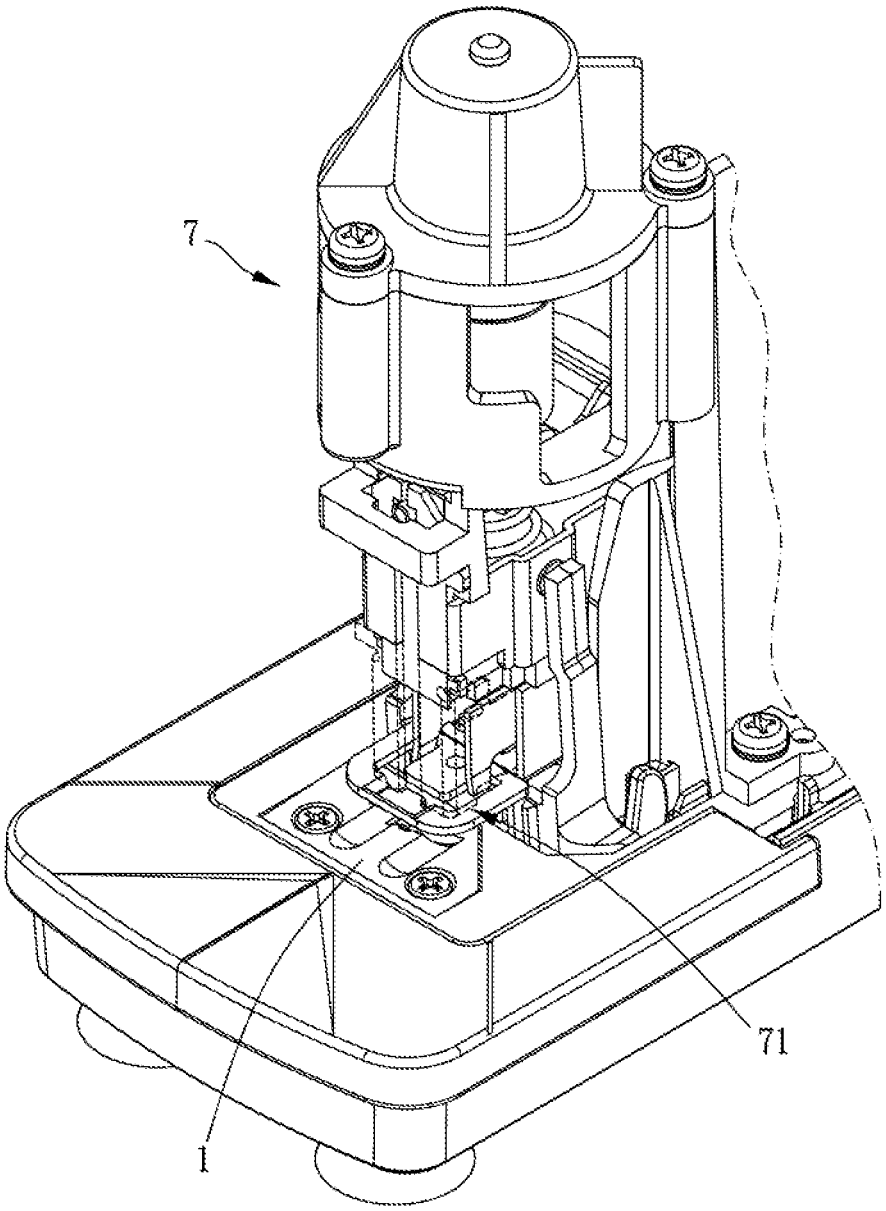
FIG. 1 is a stereogram of a stapler of an embodiment of the present invention.
Figure 2:
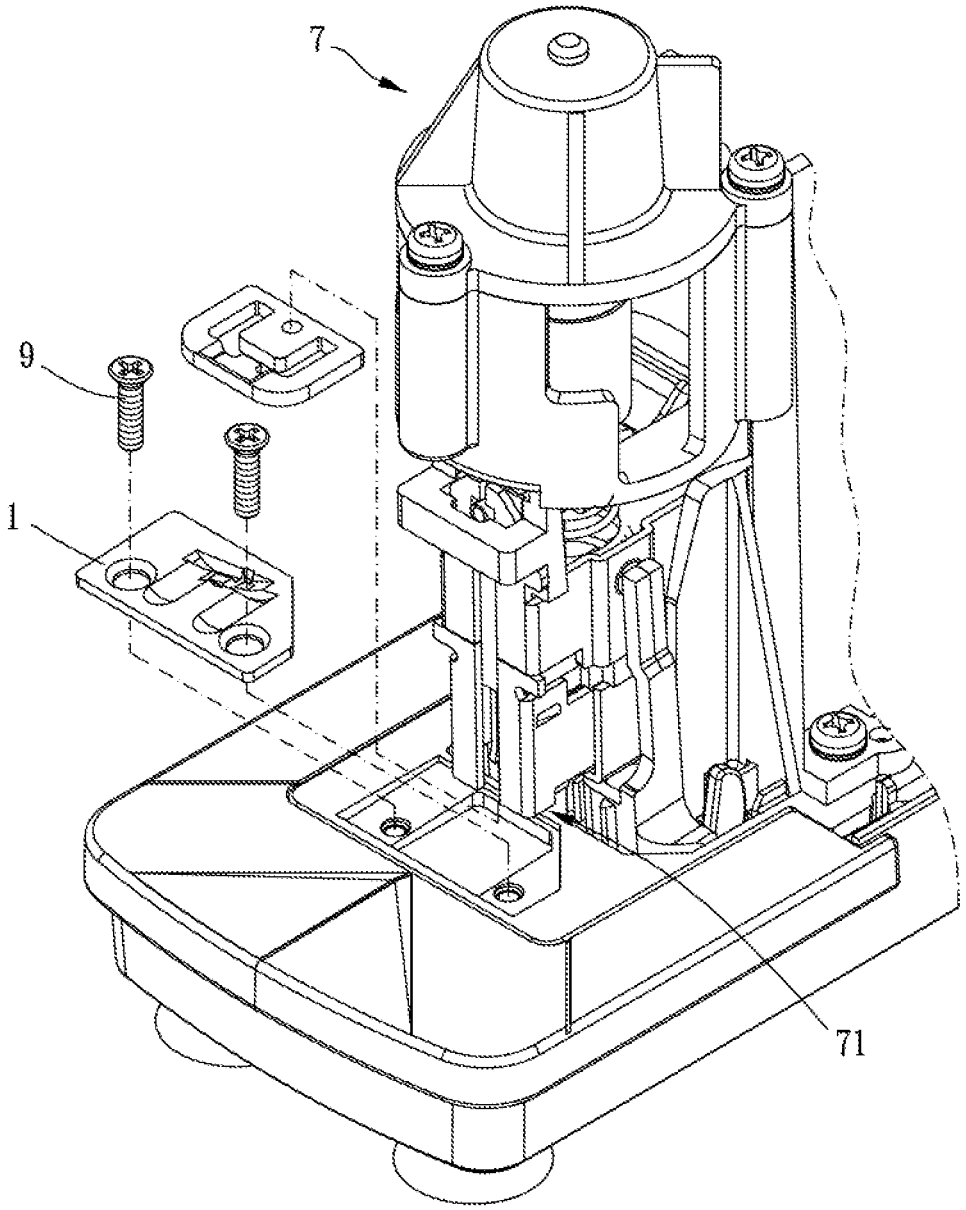
FIG. 2 is a drawing showing an anvil piece being separated from the stapler of the embodiment of the present invention.
Figure 3:
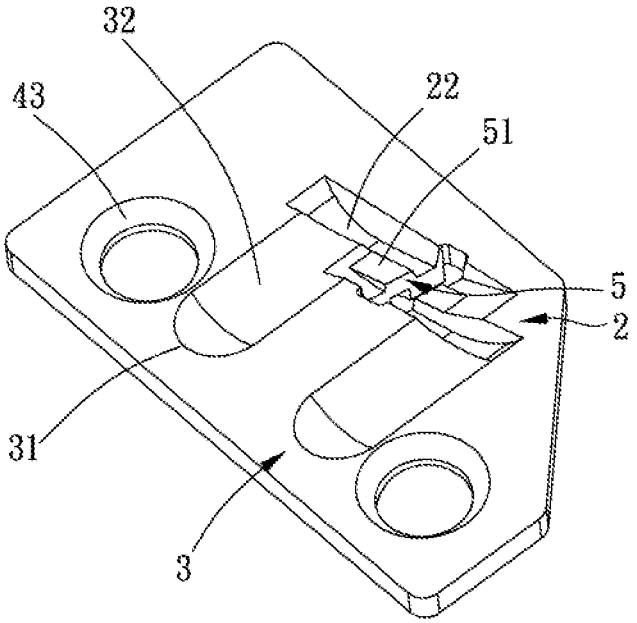
FIGS. 3 to 7 are drawings showing the anvil piece of the embodiment of the present invention from different perspectives.
Figure 4:
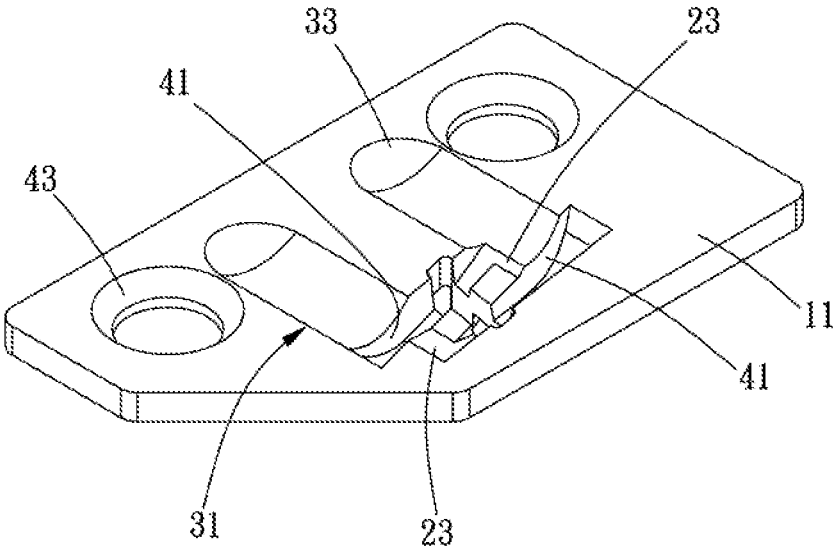
Figure 5:
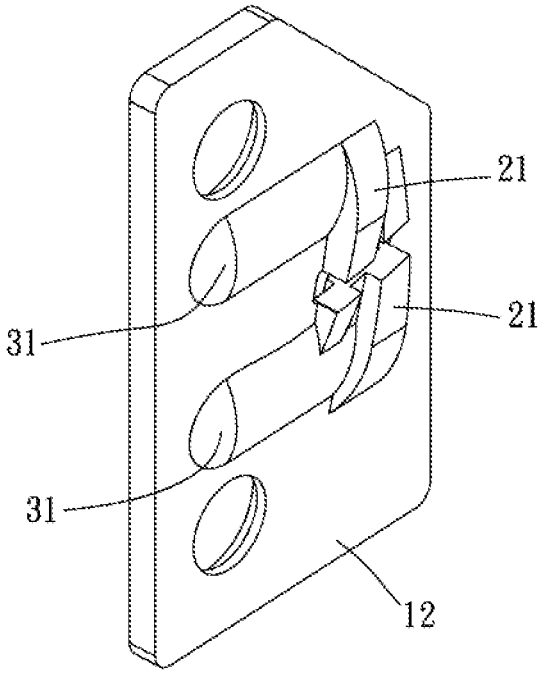
Figure 6:
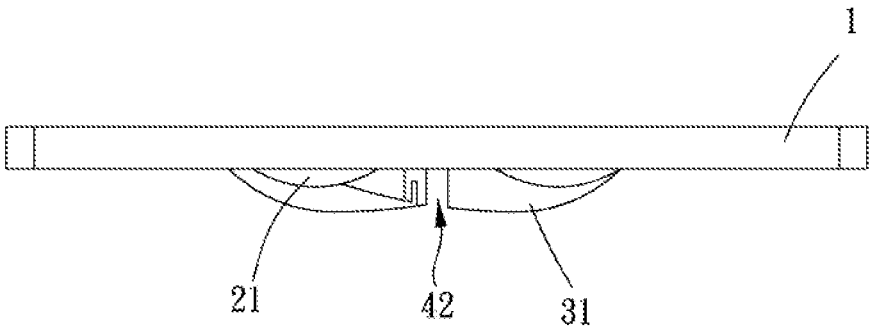
Figure 7:
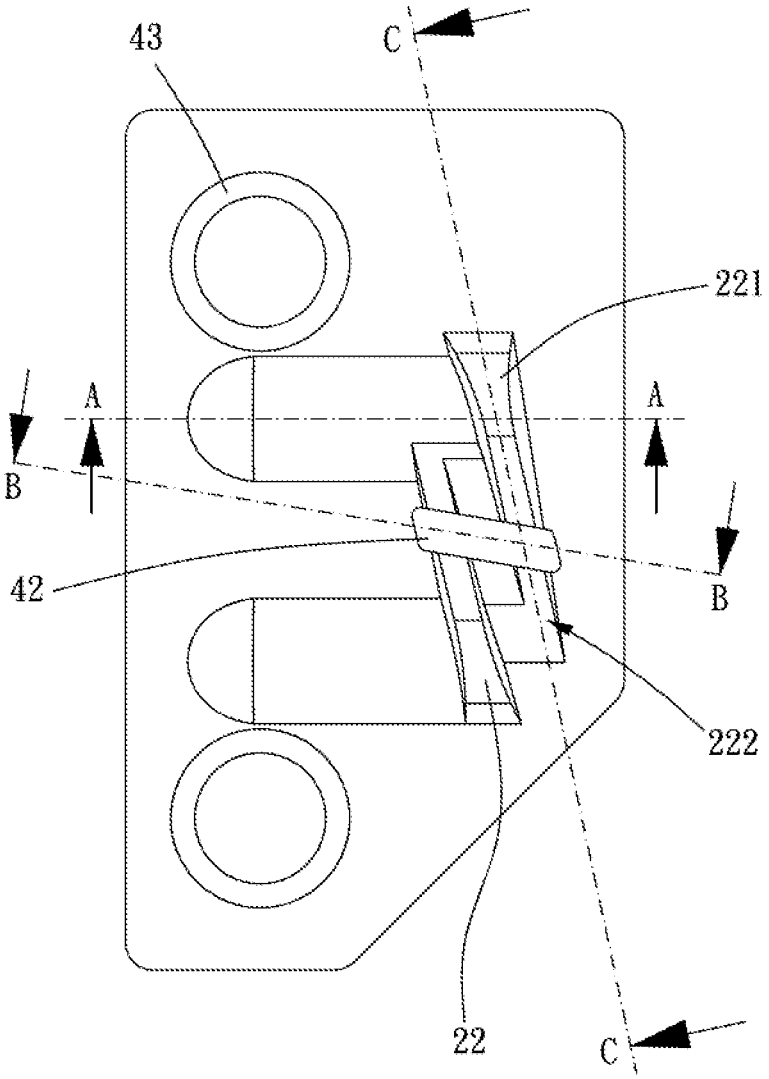
Figure 8:
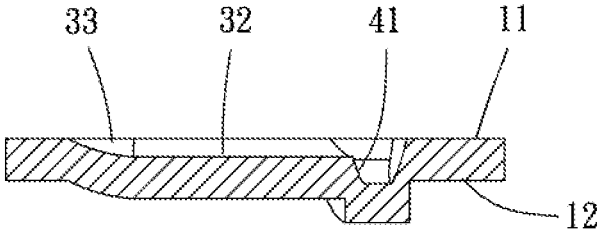
FIG. 8 is a cross-sectional view, taken along line A-A in FIG. 7.
Figure 9:
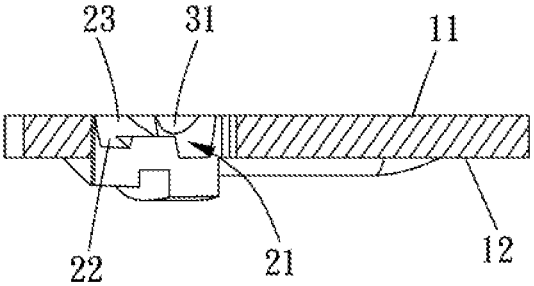
FIG. 9 is a cross-sectional view, taken along line B-B in FIG. 7.
Figure 10:
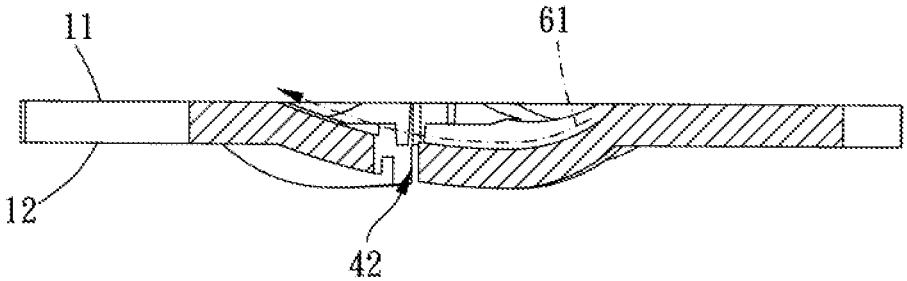
FIG. 10 is a cross-sectional view, taken along line C-C in FIG. 7.
Figure 11:
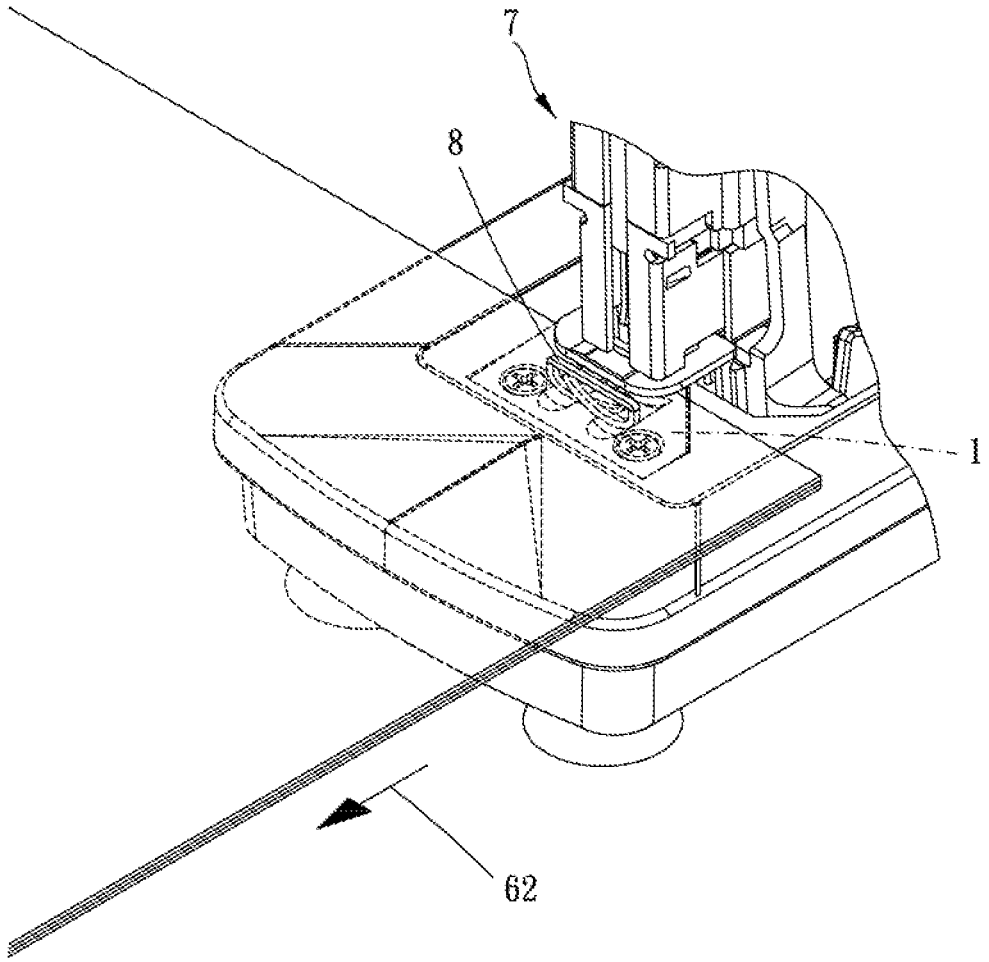
FIG. 11 is a drawing showing objects to be extracted.
Figure 12:
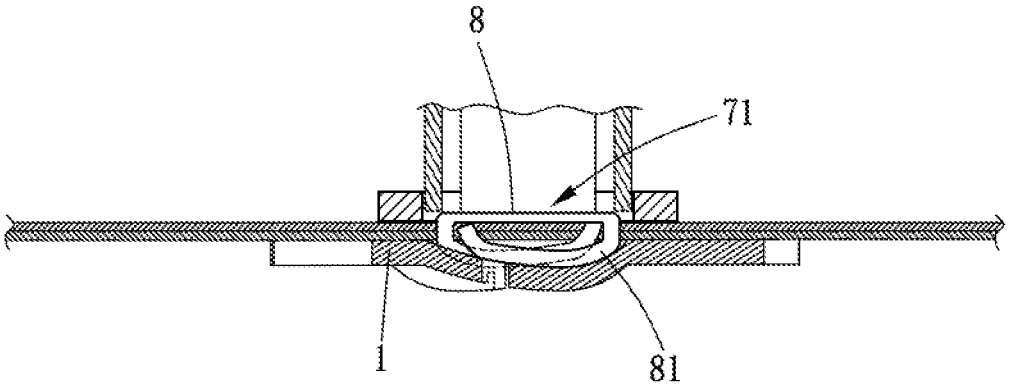
FIG. 12 is a cross-sectional view of FIG. 11.

Please refer to FIGS. 1 to 12 for an embodiment of the present invention, an anvil piece of a stapler 7 is provided, including a main body 1, a crimp groove unit 2 and an export unit 3.

The crimp groove unit 2 is recessed on the main body 1 for corresponding to a staple outlet 71, the crimp groove unit 2 includes at least one crimp groove 21, each said crimp groove 21 is for receiving a leg 81 of a staple 8, each said crimp groove 21 has a blocking face 22 which extends along a guiding path 61, and each said blocking face 22 is for blocking the leg 81 and making the leg 81 bend along the guiding path 61; the export unit 3 is recessed on the main body 1 and communicates with the crimp groove unit 2 on an extraction direction 62, the extraction direction 62 is transverse to the guiding path 61 and away from the crimp groove unit 2, the export unit 3 includes at least exporting groove 31, each said exporting groove 31 has an exporting face 32, and each said exporting face 32 is for the leg 81 which is bent to abuttingly slide therealong.

When objects to be stapled (for example, a plurality of papers) are thicker, the export unit 3 provides sufficient allowance for the staple 8 which is bent so that the staple 8 can move from the crimp groove unit 2 to the export unit 3 and slide away from the anvil piece along the exporting face 32. In other words, a user can extract the objects to be stapled smoothly away from the stapler 7 along the extraction direction 62 after the objects to be stapled are stapled. In addition, the export unit 3 can make sure that the leg 81 of the staple 8 will not deform due to unexpected impacts or hinders during a process of extraction so as to ensure connection stability between the staple 8 and the objects to be stapled.

In this embodiment, the anvil piece further has two engagement holes 43, the export unit 3 is located between the two engagement holes 43, each of the two engagement holes 43 is for an engaging member 9 to be disposed therethrough to be connected to the stapler 7 (the stapler may be operated manually or electrically) so as to make the anvil piece positioned on the stapler 7. In addition, the main body 1 is made of a metal, so the main body 1 has a strong structure to make the leg 81 bend and has a preferable service life. In addition, a number of the at least one crimp groove 21 is two, a number of the at least one exporting groove 31 is two, and the two crimp grooves 21 are spacingly arranged and respectively communicate with the two exporting grooves 31 on the extraction direction 62. The exporting groove 31 is non-penetrative through the main body 1 on the extraction direction 62, so the main body 1 can keep a more integral structure and will not be broken easily. It is understandable that the two crimp grooves 21 may be arranged in other ways, and in other embodiments, the two crimp grooves may be integrally formed on the same straight line.

Preferably, the anvil piece further includes a through slot 42, and the through slot 42 is disposed through the main body 1 and across the crimp groove unit 2. When a shape of the anvil piece is slightly different due to processing error, the through slot 42 provides some deformation allowance to allow the anvil piece to be assembled on the stapler 7. The through slot 42 is oblique to the crimp groove unit 2 and the export unit 3 to provide deformation allowance in different extents and from different directions. In addition, if a foreign object falls into the crimp groove unit 2, the leg 81 can push the foreign object into the through slot 42 when a bending process so that the foreign object will not hinders the leg 81 from moving.

It is to be noted that the main body 1 has a first face 11 and a second face 12 which is opposite to the first face 11, the main body 1 is trapezoid, two of the crimp grooves 21 are oblique to the extraction direction 62, and the two crimp grooves 21 are partly overlapped with each other on the extraction direction 62. The crimp groove 21 and the exporting groove 31 are dented from the first face 11 toward the second face 12, the crimp groove 21 is greater than the exporting groove 31 in greatest depth, the blocking face 22 and the exporting face 32 have a stepped face 41 therebetween, and the stepped face 41 provides a lateral restriction force to the leg 81 so that the leg 81 can bend along the guiding path 61 exactly during a bending process.

Preferably, the stepped face 41 obliquely extends from the blocking face 22 along the extraction direction 62 to be connected to the exporting face 32, when the user wants to extract the objects to be stapled, the leg 81 receives a force and can smoothly abuttingly slide along the stepped face 41 and move along the extraction direction 62 to extract from the crimp groove 21. It is understandable that the exporting groove 31 further has a wall 33, preferably the wall 33 is curvedly connected to the exporting face 32 and the first face 11 so that the leg 81 can abuttingly slide along the wall 33 to extract from the exporting groove 31.

In this embodiment, the crimp groove unit 2 and the export unit 3 are formed on the main body 1 through stamping so that it is convenient and fast to manufacture and process the anvil piece. As viewed along the extraction direction 62, the crimp groove 21 protrudes beyond the second face 12, and a farthest distance between a protrusive part of the crimp groove 21 and the second face 12 is substantially equal to a distance between the first face 11 and the second face 12. Similarly, the exporting groove 31 protrudes beyond the second face 12, and a farthest distance between a protrusive part of the exporting groove 31 and the second face 12 is substantially equal to half the distance between the first face 11 and the second face 12.

Specifically, a first end portion 221 of the blocking face 22 is for receiving and importing the leg 81, a second end portion 222 of the blocking face 22 is for exporting the leg 81, the guiding path 61 extends from the first end portion 221 toward the second end portion 222 to be in a hooked shape, the first end portion 221 has a greatest depth, and the exporting groove 31 corresponds to and communicates with the first end portion 221 on the extraction direction 62 so as to ensure that after the leg 81 is bent, an enlarged part can slide along the exporting groove 31 smoothly.

More specifically, each said crimp groove 21 further has a beveled surface 23 which is oblique to the first face 11, and the beveled surface 23 extends from the second end portion 222 of one of the at least crimp groove 21 along the extraction direction 62 to the first end portion 221 of another of the at least crimp groove 21. In addition, the two crimp grooves 21 define a barrier block 5 therebetween, a top face 51 of the barrier block 5 is lower than the first face 11, two opposite ends of the top face 51 are respectively connected to the beveled surface 23.

Given the above, with the anvil piece of the stapler, the leg which is bent can move smoothly from the crimp groove to the exporting groove and abuttingly slide along the exporting face of the exporting groove so as to quickly extract from the main body. Therefore, when the user wants to staple the objects which are thicker, the object stapled can be extracted from the stapler smoothly without being stuck.

While we have shown and described various embodiments in accordance with the present invention, it should be clear to those skilled in the art that further embodiments may be made without departing from the scope of the present invention.

What is claimed is:

1. An anvil piece of a stapler, including:

a main body;

a crimp groove unit, recessed on the main body for corresponding to a staple outlet, including at least one crimp groove, each said crimp groove for receiving a leg of a staple, each said crimp groove having a blocking face which extends along a guiding path, each said blocking face for blocking the leg and making the leg bend along the guiding path;

an export unit, recessed on the main body and communicating with the crimp groove unit on an extraction direction, the extraction direction being transverse to the guiding path and away from the crimp groove unit, the export unit including at least exporting groove, each said exporting groove having an exporting face, each said exporting face for the leg which is bent to abuttingly slide therealong.

2. The anvil piece of the stapler of claim 1, further including a through slot, the through slot disposed through the main body and across the crimp groove unit.

3. The anvil piece of the stapler of claim 1, wherein a number of the at least one crimp groove is two, a number of the at least one exporting groove is two, and the two crimp grooves respectively communicate with the two exporting grooves on the extraction direction.

4. The anvil piece of the stapler of claim 3, wherein the main body has a first face and a second face which is opposite to the first face, the crimp groove and the exporting groove are dented from the first face toward the second face, the crimp groove is greater than the exporting groove in greatest depth, the blocking face and the exporting face have a stepped face therebetween, and the stepped face obliquely extends from the blocking face along the extraction direction to be connected to the exporting face.

5. The anvil piece of the stapler of claim 4, wherein a first end portion of the blocking face is for receiving and importing the leg, a second end portion of the blocking face is for exporting the leg, the guiding path extends from the first end portion toward the second end portion to be in a hooked shape, the first end portion has a greatest depth, and the exporting groove corresponds to and communicates with the first end portion on the extraction direction.

6. The anvil piece of the stapler of claim 5, wherein each said crimp groove further has a beveled surface which is oblique to the first face, and the beveled surface extends from the second end portion of one of the at least crimp groove along the extraction direction to the first end portion of another of the at least crimp groove.

7. The anvil piece of the stapler of claim 4, wherein as viewed along the extraction direction, the crimp groove protrudes beyond the second face, and a farthest distance between a protrusive part of the crimp groove and the second face is substantially equal to a distance between the first face and the second face.

8. The anvil piece of the stapler of claim 7, wherein as viewed along the extraction direction, the exporting groove protrudes beyond the second face, and a farthest distance between a protrusive part of the exporting groove and the second face is substantially equal to half the distance between the first face and the second face.

9. The anvil piece of the stapler of claim 1, wherein the crimp groove unit and the export unit are formed on the main body through stamping.

10. The anvil piece of the stapler of claim 6, further including a through slot, the through slot disposed through the main body and across the crimp groove unit; as viewed along the extraction direction, the crimp groove protruding beyond the second face, a farthest distance between a protrusive part of the crimp groove and the second face being substantially equal to a distance between the first face and the second face; as viewed along the extraction direction, the exporting groove protruding beyond the second face, a farthest distance between a protrusive part of the exporting groove and the second face being substantially equal to half the distance between the first face and the second face; the crimp groove unit and the export unit formed on the main body through stamping; the exporting groove being non-penetrative through the main body on the extraction direction; as viewed along a direction facing the first face, two of the crimp grooves being oblique to the extraction direction, the two crimp grooves being partly overlapped with each other on the extraction direction; the anvil piece further having two engagement holes, the export unit being located between the two engagement holes, each of the two engagement holes being for an engaging member to be disposed therethrough to be connected to a stapler; the exporting groove further having a wall, the wall being curvedly connected to the exporting face and the first face; as viewed along the direction facing the first face, the main body being trapezoid; the main body being made of a metal; the two crimp grooves defining a barrier block therebetween, a top face of the barrier block being lower than the first face, two opposite ends of the top face being respectively connected to the beveled surface; the through slot being oblique to the crimp groove unit and the export unit.

* * * * *